US010689190B2

(12) United States Patent
Granger

(10) Patent No.: US 10,689,190 B2
(45) Date of Patent: Jun. 23, 2020

(54) TRASH CAN CLIP SYSTEM AND METHOD

(71) Applicant: Billie Toba Hale, Jr., Houston, TX (US)

(72) Inventor: Timothy L. Granger, Houston, TX (US)

(73) Assignee: Billie Toba Hale, Jr., Houston, TX (US)

( * ) Notice: Subject to any disclaimer, the term of this patent is extended or adjusted under 35 U.S.C. 154(b) by 0 days.

(21) Appl. No.: 16/135,107

(22) Filed: Sep. 19, 2018

(65) Prior Publication Data

US 2020/0087060 A1 Mar. 19, 2020

(51) Int. Cl.

| | |
|---|---|
| ***B65F 1/14*** | (2006.01) |
| ***B65F 1/00*** | (2006.01) |
| ***B65F 1/08*** | (2006.01) |
| *B65F 1/16* | (2006.01) |

(52) U.S. Cl.

CPC ..... *B65F 1/0006* (2013.01); *B65F 1/085* (2013.01); *B65F 1/1415* (2013.01); *B65F 1/1615* (2013.01); *B65F 2210/148* (2013.01)

(58) Field of Classification Search

CPC ..... B65F 1/06; B65F 1/085; B65F 1/1415; B65F 2210/148; B65F 2210/18; B65B 67/1227; B65B 67/1233

USPC ..... 248/99, 101

See application file for complete search history.

(56) References Cited

U.S. PATENT DOCUMENTS

| | | | | |
|---|---|---|---|---|
| 4,955,496 | A * | 9/1990 | Nelson | B65F 1/1415 141/114 |
| 5,314,151 | A * | 5/1994 | Carter-Mann | B65B 67/1227 248/100 |
| 5,639,050 | A * | 6/1997 | Peterson | B65B 67/1205 220/495.08 |
| 6,017,069 | A * | 1/2000 | Imms | B65B 67/1233 248/101 |
| 6,176,455 | B1 | 1/2001 | Ma | |
| 6,343,409 | B1 | 2/2002 | McAllister | |
| 6,484,374 | B2 | 11/2002 | McAllister | |
| 8,066,144 | B2 * | 11/2011 | McNamara | B65F 1/06 220/495.01 |
| 8,720,833 | B2 * | 5/2014 | Jack | B65B 67/04 248/100 |
| 8,851,542 | B2 * | 10/2014 | Faraone | A47L 13/52 15/257.1 |
| 9,205,942 | B1 * | 12/2015 | McMiller | B65B 67/12 |
| 2002/0108219 | A1 | 8/2002 | McAllister | |
| 2003/0079319 | A1 | 5/2003 | McAllister | |

(Continued)

FOREIGN PATENT DOCUMENTS

CN 206203160U B1 5/2017

*Primary Examiner* — Bradley Duckworth

(74) *Attorney, Agent, or Firm* — Keeling Law, LLC; Kenneth A. Keeling; Mark S. Solomon

(57) ABSTRACT

Embodiments of an apparatus of the present invention generally include a trash can clip system which includes a substantially vertically-oriented lip, wherein one or more voids are disposed along the lip, and one or more substantially u-shaped clips, wherein each clip is slidingly movable along the lip, such that each clip can be provided in an engaged position with respect to the lip, or provided in a disengaged position within a lip void, and outwardly rotated in the disengaged position. A method of utilizing an embodiment of trash can clip system of the present invention is also provided.

20 Claims, 5 Drawing Sheets

(56) References Cited

U.S. PATENT DOCUMENTS

| | | | | |
|---|---|---|---|---|
| 2004/0200938 | A1* | 10/2004 | Forlivio | B65B 67/1227 248/213.2 |
| 2009/0114778 | A1* | 5/2009 | Payne | B65B 67/1233 248/95 |
| 2010/0218370 | A1 | 9/2010 | Lin | |
| 2015/0232267 | A1* | 8/2015 | Leach | B65F 1/1415 248/101 |

* cited by examiner

TRASH CAN CLIP SYSTEM AND METHOD

CROSS-REFERENCE TO RELATED APPLICATIONS

Not applicable.

STATEMENT REGARDING FEDERALLY SPONSORED RESEARCH OR DEVELOPMENT

Not applicable.

FIELD OF THE INVENTION

The present invention relates generally to a trash receptacle system useful for trash bag securement. More specifically, the present invention relates to a trash receptacle system that employs a one or more non-detachable clips to affix a trash bag there within.

BACKGROUND

Trash receptacles (cans) are commonly used to collect garbage for disposal. Unfortunately, refuse placed there within may comprise components that would stain or otherwise pollute the inner surfaces of the receptacle. Such contamination of the trash receptacle can result in, among other things, foul odors emanating therefrom. Accordingly, it is often desirable to utilize a disposable trash liner (bag) in conjunction with a waste receptacle so that the rubbish does not come into contact with the inner surface of the trash can. This prevents the buildup of undesirable substances on the inside of the trash can, thereby minimizing odors and also degradation of the inner surface of the trash can.

Generally, trash bags are placed inside a trash can such that the upper opening of the bag is disposed proximate the upper portion of the trash can. Traditionally, the trash bag is draped over the top lip of the trash can so that the entirety of the trash can's inner surface is protected. Unfortunately, during the process of placing garbage in the trash can, the liner can become dislodged from the lip, and fall into the trash can. Often, such an occurrence results in contact between some of the garbage and a portion of the upper inner surface of the trash can. At the very least, effort is required to re-position the liner over the trash can lip.

In light of the above-mentioned issue, impromptu means have been utilized to secure the trash bag to (or proximate to) the upper lip of the trash can. Historically, a simple fastening device, such as a clip (e.g., a paper clip, binder clip, or "chip clip"), or the like, has been utilized for such purpose. Additionally, expandable retention devices (e.g., rubber bands and the like) have been used, wherein the trash bag is draped over the upper trash can lip, whereby enough of the trash bag is disposed around the outside upper portion of the trash can to allow for securement of the trash bag between the rubber band and the outside upper surface of the trash can. Routinely, however, use of these primitive securement means is unsatisfactory as they are not specifically sized for the purpose, are not aesthetically pleasing, and/or may be misplaced when not in use.

Specially designed mechanisms for supporting trash bags within trash cans have also been previously provided. Examples of such mechanisms are disclosed in U.S. Pat. No. 6,176,455 to Ma, U.S. Pat. Nos. 6,343,409 and 6,484,374 to McAllister, United States Patent Application Publication No. 2010/0218370 by Lin, United States Patent Application Publication No. 2002/0108219 by McAllister, and Chinese Patent No. CN 206203160 (U) to Jiang Ao. Due to limitations of these mechanisms, however, it would still be advantageous to provide an improved means of securing a trash bag within a trash can.

BRIEF SUMMARY OF THE INVENTION

Embodiments of an apparatus of the present invention generally comprise a system comprising one or more substantially u-shaped clips disposed proximate the top (open) end of a trash can, wherein, each clip is fixedly attached to the trash can by means of an elongated component integral with or attached to the trash can which extends through a void in the clip extending longitudinally there through, each clip is slidingly movable along the upper edge of the trash can, wherein, in a first, engaging location, each clip is positioned so that a portion of an upper lip of the trash can is provided within the u-shaped opening of the clip, and in a second, disengaging location, each clip is positioned within a void area in the trash can upper lip such that the clip can be pivoted outward about the elongated component. Embodiments of a method of employing the trash can clip system are also provided.

BRIEF DESCRIPTION OF THE DRAWINGS

For a more complete understanding of the exemplary embodiments, reference is now made to the following Description of Exemplary Embodiments of the Invention, taken in conjunction with the accompanying drawings, in which.

DETAILED DESCRIPTION OF EXEMPLARY EMBODIMENTS OF THE INVENTION

Figure 1:
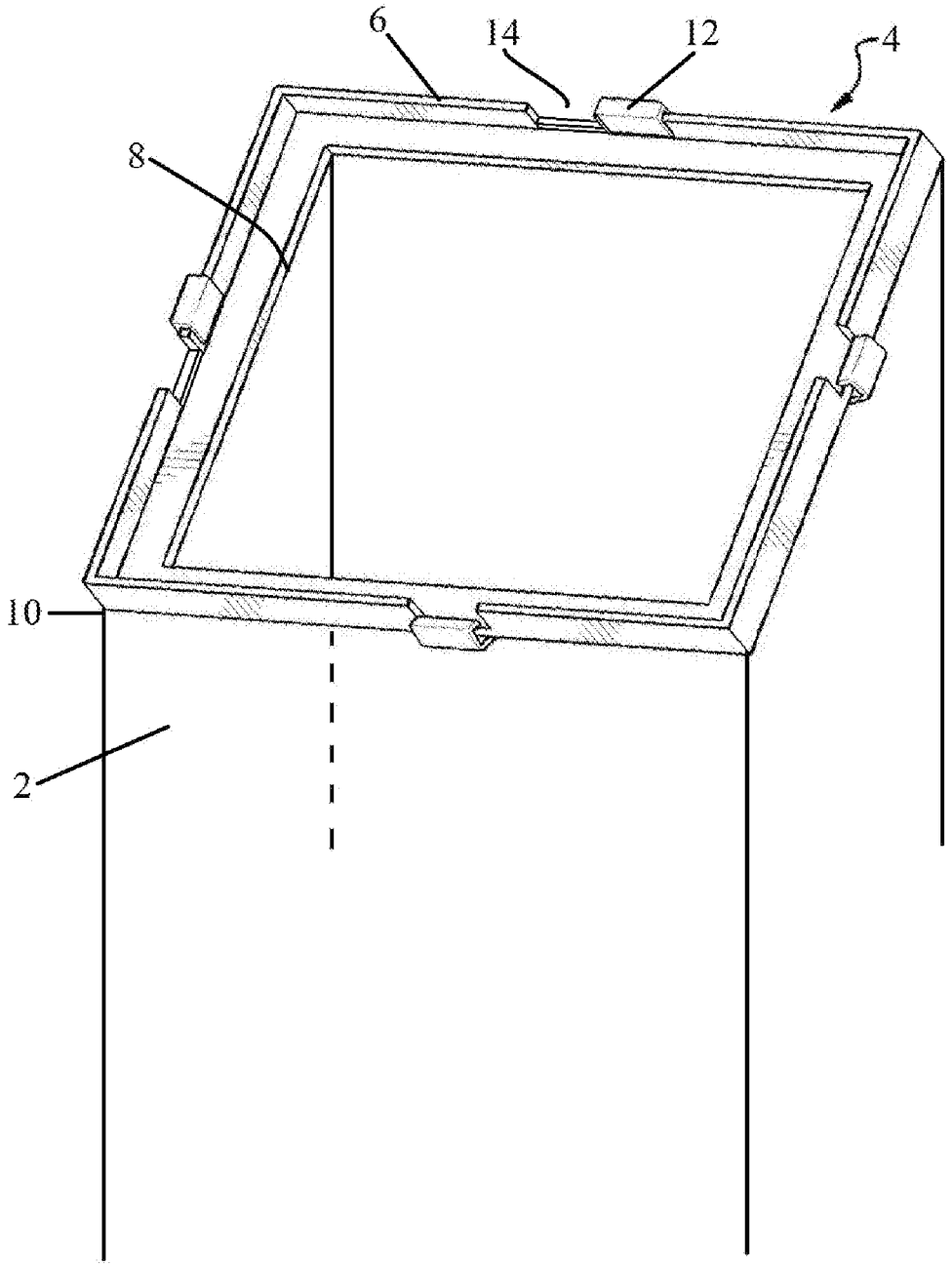
FIG. 1 depicts a trash can comprising an embodiment of a trash can clip system of the present invention.

The exemplary embodiments are best understood by referring to the drawings with like numerals being used for like and corresponding parts of the various drawings. Use of relative terms herein, such as "top," "bottom," "upper," "lower," "above," "below," "inward," "outward," and the like, are used for illustrative purposes only and are not intended to limit the invention to a disclosed orientation or arrangement.

FIG. 1 depicts a trash can 2 comprising an embodiment of a trash can clip system 4 of the present invention. Herein, the term "trash can" is used to generically refer to any container used to temporarily hold items for disposal. Although the trash can clip system 4 shown in FIG. 1 is substantially square shaped, the invention is not so limited and trash can clip system 4 may be of any useful shape, including, but not limited to, rectangular, round, oval, or of an irregular shape, according to the shape of an opening 8 of trash can 2. In one embodiment, a trash can clip system 4 extends around at least a portion of an upper end 10 of trash can 2. In various embodiments, trash can clip system 4 may be attachable to trash can 2 or integral therewith. While the trash can clip system 4 shown in FIG. 1 comprises a single component, the invention is not so limited, and in other embodiments (not shown), trash can clip system 4 may comprise a plurality of cooperatively arrangeable and/or connectable components. In various embodiments, a trash can clip system 4 may comprise any suitable material(s), such as, but not limited to, a natural or synthetic polymer (e.g., plastic or rubber), metal, graphite, or wood.

In one embodiment, trash can clip system 4 comprises a lip 6 and one or more clips 12. Although in the embodiment shown in FIG. 1 the lip 6 extends substantially circumferentially around opening 8, other configurations are contemplated. In other embodiments (not shown), lip 6 may extend along only a portion or portions of an upper edge (not visible) of trash can 2. In various embodiments, lip 6 may impart a circumference onto trash can clip system 4 that is greater than, the same as, or smaller than the circumference of opening 8 of trash can 2. The embodiment of lip 6 depicted in FIG. 1 (and FIGS. 3A-3C and 4A-4B, discussed infra) is substantially rectangular shaped, but lip 6 may comprise any shape useful with a clip 12, which is described in more detail below. Although lip 6 is depicted in FIG. 1 as extending substantially perpendicularly in relation to the plane in which trash can clip system 4 resides, the invention is not so limited and other relative orientations, including, but not limited to, all or portions of lip 6 extending at least somewhat inward or outward with respect to the long (vertical) axis of the trash can 2.

In one embodiment, trash can clip system 4 comprises one or more void areas (gaps) 14 along lip 6. In various embodiments, an opening 14 may encompass the entirety (vertically) of lip 6 (indicated by dimension 52 in FIGS. 3A-3C), or only a portion thereof. In one aspect, an opening 14 may be sized to accommodate the entire length of a clip 12 there within. In one embodiment, when a plurality of clips 12 are employed, the clips 12 may be evenly spaced about the circumference of the trash can clip system 4, such as depicted in the embodiment of FIG. 1; however, the invention is not so limited and other arrangements may be utilized.

Figure 2:
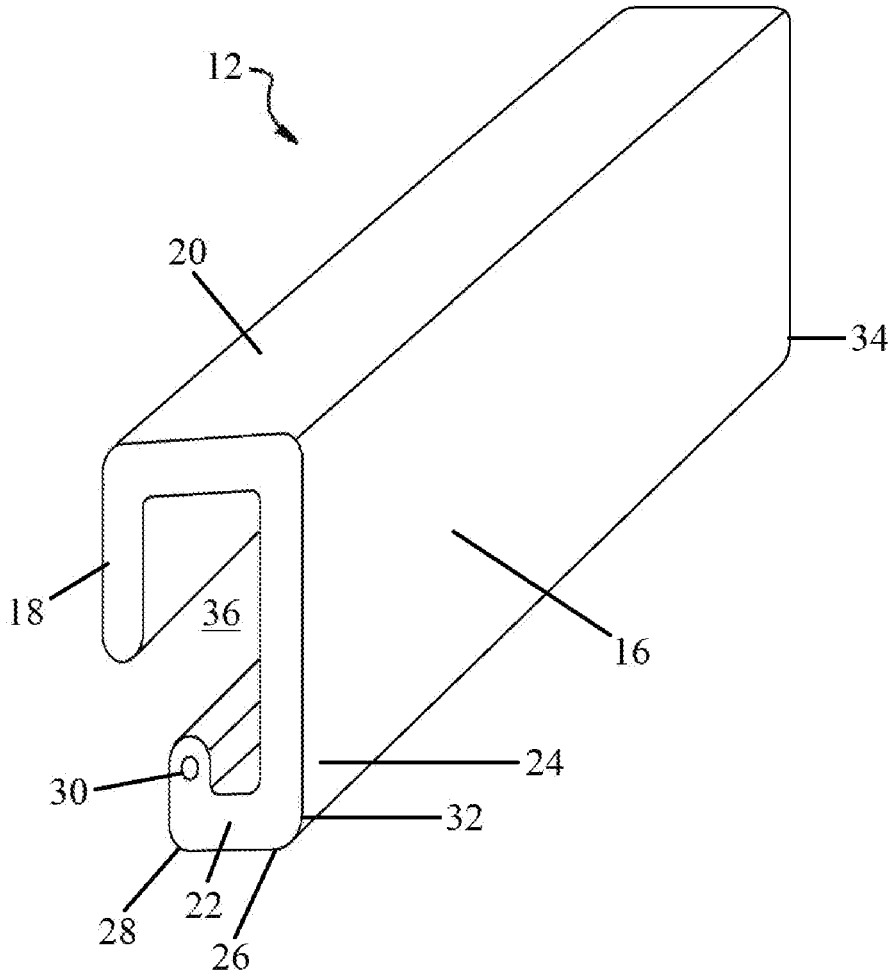
FIG. 2 depicts a perspective view of an embodiment of a trash can clip of the present invention

Referring now to FIG. 2, in one embodiment, clip 12 comprises a substantially u-shaped, elongated component comprising an outer sidewall 16, an inner partial sidewall 18, and an upper transverse wall 20. In various embodiments, a clip 12 may comprise any suitable material(s), such as, but not limited to, a natural or synthetic polymer (e.g., plastic or rubber), metal, graphite, or wood. In other embodiments (not shown), a clip 12 may comprise a different internal and/or external geometry, as would be understood by one skilled in the art. In one embodiment, clip 12 comprises an interior space 36 defined in part by inner partial sidewall 18, upper transverse wall 20, and at least a portion of outer sidewall 16. In one embodiment, clip 12 comprises bottom end component 22. In one embodiment, bottom end component 22, proximate a first end 26 thereof, is attached to or integral with a bottom portion 24 of outer sidewall 16. In one embodiment, within a second end 28 of bottom end component 22 is disposed an orifice 30. In one embodiment, orifice 30 extends through bottom end component 22 from a first end 32 of clip 12 to a second end 34 of clip 12.

In one embodiment, orifice 30 is adapted and configured such that at least a portion of a pin (rod) 42 (shown in FIGS. 4A & 4B) is extendable there through. In one embodiment, bottom end component 22 and orifice 30 are adapted and configured such that when a rod 42 is positioned there within, clip 12 is at least partially rotatable there about, as discussed in more detail below. In other embodiments (not shown), rotation of clip 12 may be achieved by other means, such as, but not limited to, hinges, springs, flexible materials, or the like, as would be understood by one skilled in the art.

Figure 3A:
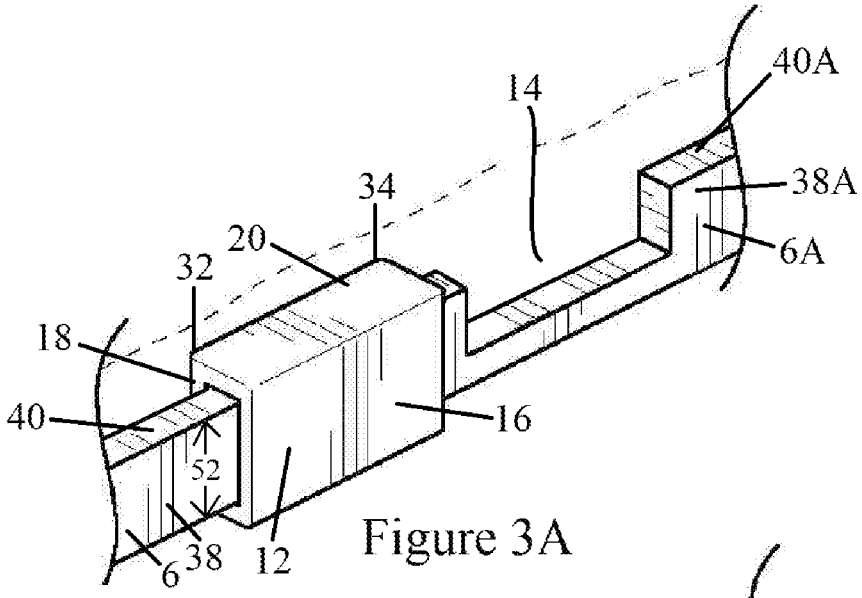
FIG. 3A depicts a perspective view of an embodiment of a trash can clip of the present invention in an engaged position.
Figure 3B:
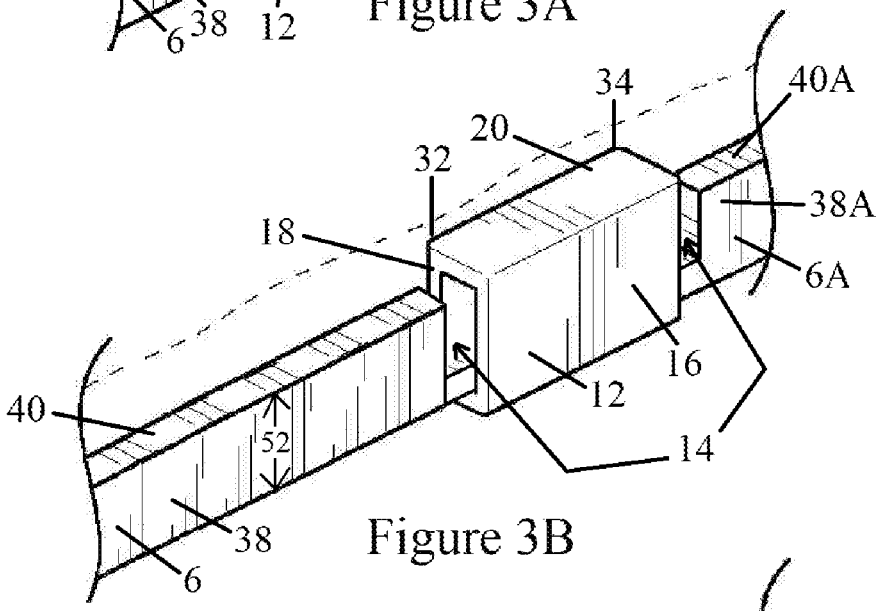
FIG. 3B depicts a perspective view of an embodiment of a trash can clip of the present invention in a disengaged position.
Figure 3C:
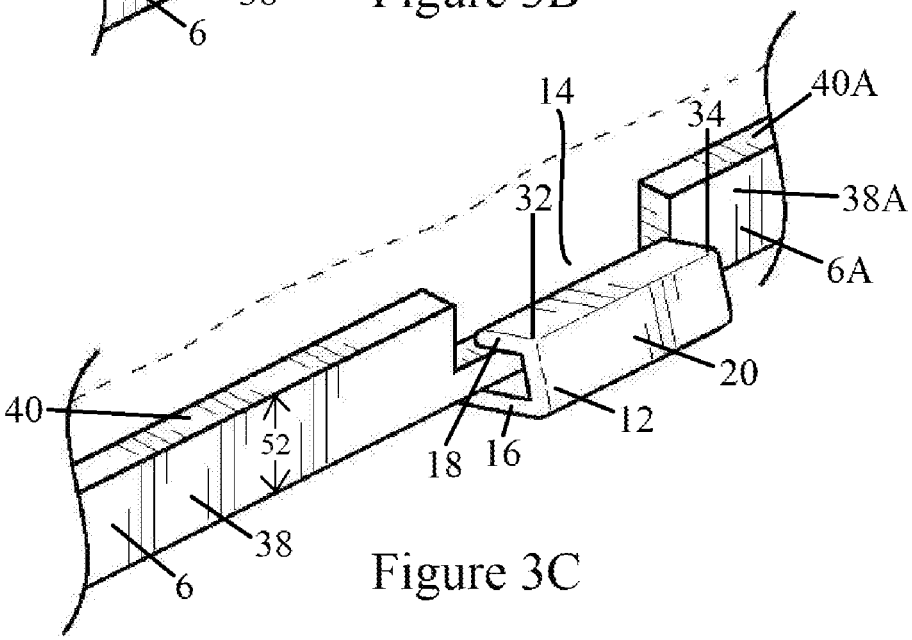
FIG. 3C depicts a perspective view of an embodiment of a trash can clip of the present invention in a disengaged and outwardly rotated position.

Referring now to FIGS. 3A, 3B, and 3C, which each depict a portion of a trash can clip system 4, in one embodiment, a clip 12 is slidingly movable along lip 6. In FIG. 3A, clip 12 is depicted in an "engaged" positioned, wherein clip 12 is disposed about lip 6, and wherein both first end 32 and second end 34 of clip 12 are displaced from gap 14. In one embodiment, interior space 36 is sized and configured such that when clip 12 is provided in an engaged position, only nominal spacing (clearance) exists between (1) a lip 6 exterior wall 38 and portions of clip 12 outer sidewall 16, (2) a lip 6 top surface 40 and clip 12 upper transverse wall 20, and/or (3) a portion of a lip 6 interior wall 44 (not visible in FIG. 3A) and clip 12 inner partial sidewall 18. (See also FIG. 4A).

Figure 4A:
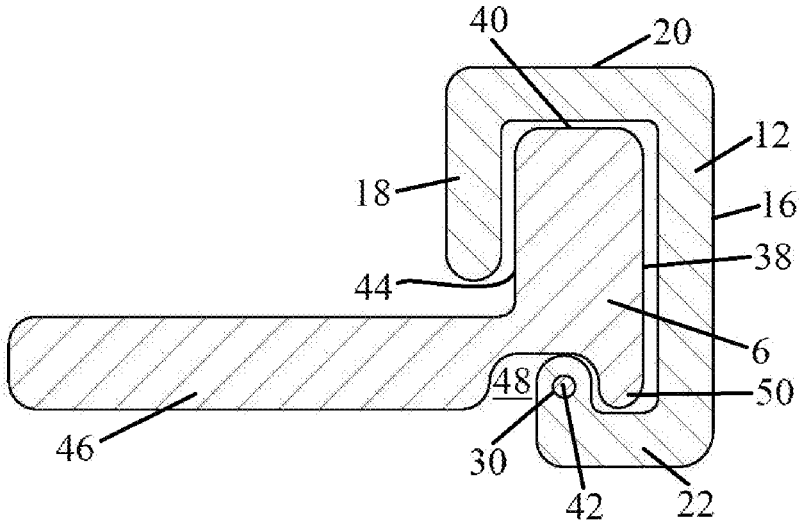
FIG. 4A depicts an end-on view of an embodiment of a trash can clip of the present invention in an engaged position.

In an embodiment shown in FIG. 3B, clip 12 is depicted in a "disengaged" positioned, wherein clip 12 is disposed within gap 14. In one embodiment, clip 12 may be slidingly advanced along trash can clip system 4 such that top surface 40 of lip 6 is not disposed within clip 12 interior space 36 (not separately labeled). In one embodiment, such displacement of clip 12 comprises lateral movement of clip 12 along rod 42 which is at least partially disposed within orifice 30, as shown in FIG. 4A. When clip 12 is provided in a disengaged position, a substantial portion of clip 12 interior space 36 is vacant.

Figure 4B:
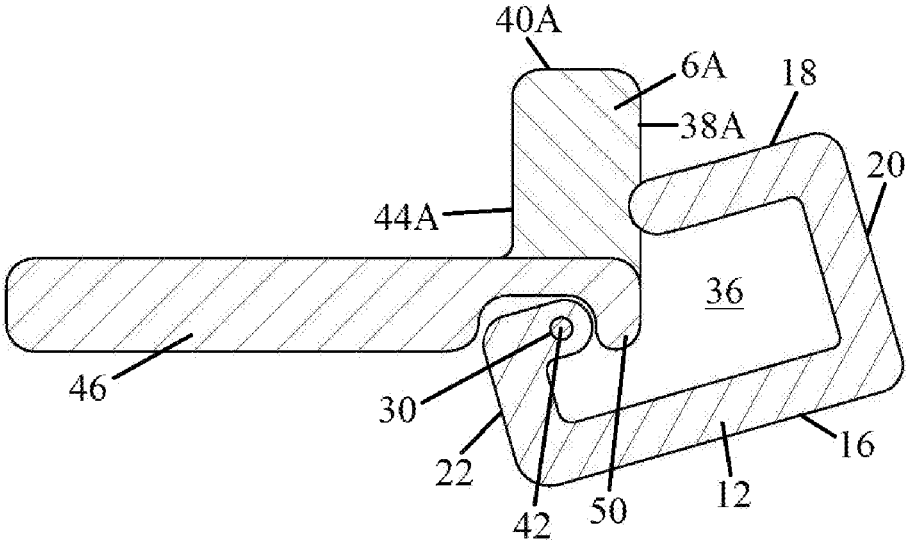
FIG. 4B depicts an end-on view of an embodiment of a trash can clip of the present invention in a disengaged and outwardly rotated position.

As shown in FIG. 3C, in one embodiment, clip 12, when provided in the disengaged position, may be outwardly rotated. In one embodiment, outward rotation of clip 12 comprises rotation (pivoting) about rod 42 which is at least partially disposed within orifice 30, as shown in FIG. 4B. In one aspect, when clip 12 is so outwardly rotated, a substantial portion of gap 14 is vacant.

Referring now to FIG. 4A, a cut-away side view of an embodiment of a portion of a trash can clip system 4 is depicted. In FIG. 4A, a clip 12 is depicted in an engaged position wherein a portion of a lip 6 is disposed partially there within. In the embodiment of FIG. 4A, within bottom end component 22 of clip 12 a portion of rod 42 is shown disposed within orifice 30. In this embodiment, a substantial portion of clip 12 interior space 36 (not separately labeled in FIG. 4A) is occupied by the portion of lip 6 positioned within clip 12. Although in the embodiment of FIG. 4A lip 6 is depicted as being connected to or integral with a miscellaneous component 46 oriented substantially perpendicular to the longitudinal axis of lip 6, such representation is for illustration purposes only, and other configurations are contemplated. In one embodiment of a trash can clip system 4, bottom end component 22 is at least partially disposed within a cavity 48 proximate a bottom section 50 of lip 6.

FIG. 4B shows a cut-away side view of an embodiment of a portion of a trash can clip system 4 wherein clip 12 has been outwardly rotated about rod 42. In the depiction of FIG. 4B, the view comprises gap 14 (not separately labeled) and lip portion 6A. (See FIGS. 3A-3C). In this description and the drawings, the item designation "A" is used to identify a separate, analogous component. In the embodiment of FIG. 4B, it can be seen that outward rotation of clip 12 provides an additional portion of bottom end component 22 within cavity 48.

Figure 5A:
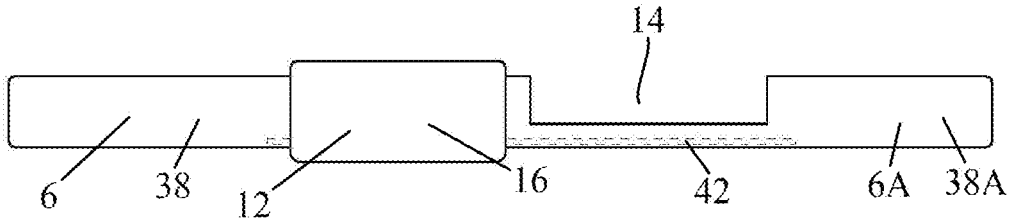
FIG. 5A depicts a side view of an embodiment of a trash can clip of the present invention in an engaged position.
Figure 5B:
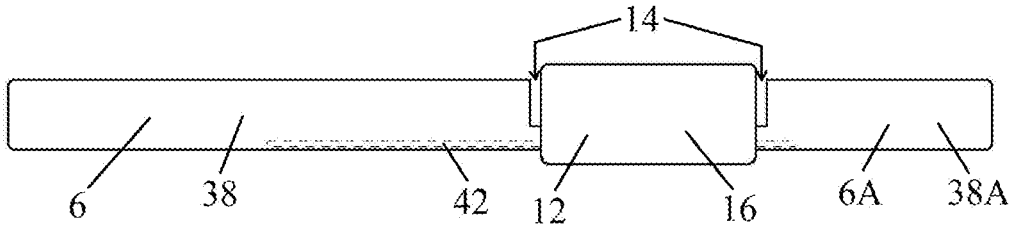
FIG. 5B depicts a side view of an embodiment of a trash can clip of the present invention in a disengaged position.
Figure 5C:
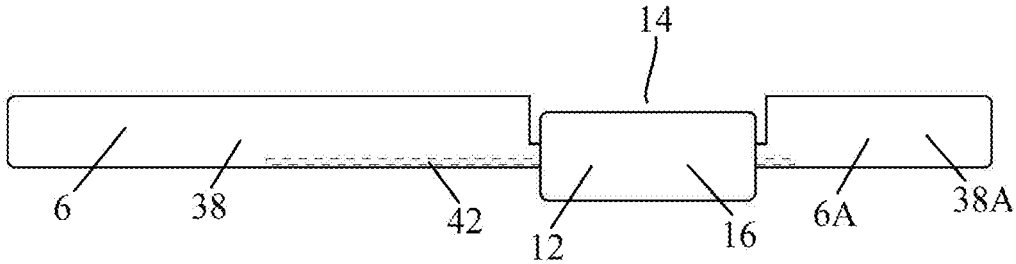
FIG. 5C depicts a side view of an embodiment of a trash can clip of the present invention in a disengaged and outwardly rotated position.

FIGS. 5A, 5B, and 5C each depict a side view of an embodiment of a portion of a trash can clip system 4. In these images, rod 42 is depicted in phantom. In various embodiments, rod 42 is connected to or integral with trash can clip system 4 or trash can 2, as would be understood by one skilled in the art. In one embodiment, rod 42 is sized, positioned, and configured such that clip 12 is movable from an engaged position to a disengaged position.

In FIG. 5A, clip 12 is disposed in an engaged position. In FIG. 5B, clip 12 is disposed in a disengaged position. In FIG. 5C, clip 12 is disposed in a disengaged position and has been outwardly rotated.

In one embodiment, a clip 12 is non-detachable; i.e., regardless of whether the clip 12 is disposed in an engaged position, a disengaged position, or outwardly rotated in a disengaged position, the clip is fixedly attached to the trash can clip system 4. In other embodiments (not shown), all or a portion of clip 12 may be removably attachable to trash can clip system 4, such that, for example, a worn or broken clip may be replaced without having to replace the entire trash can clip system 4.

Operation

In one embodiment, a trash can clip system 4 comprising one or more clips 12 is provided proximate an opening 8 of a trash can 2. Consistent with the description above, each clip 12 is provided in a disengaged position and rotated outward. A trash bag (not shown) is provided at least partially within the interior of the trash can 2. A circumferential upper portion of the trash bag, proximate the open end thereof, is provided on or draped over top surface 40 of lip 6. Each clip 12 is rotated inward and then each clip is slidingly advanced along lip 6 so as to be provided in an engaged position. In this manner, a portion of the trash bag is confined between lip 6 and a portion of the interior surface of clip 12. According, the trash bag is secured within the trash can 2. To remove the trash bag, each clip is slidingly advanced from an engaged position to a disengaged position, and then rotated outward. The trash bag may then be removed.

Method

In one embodiment, a method of, comprises the following steps:

A Trash Can Clip System Provision Step, comprising providing a trash can clip system, such as trash can clip system 4, comprising one or more clips, such as clips 12, proximate the opening of a trash can, such as trash can 2;

A Trash Can Clip System Readying Step, comprising providing each clip in a disengaged position and rotating each clip outward;

A Trash Bag Positioning Step, comprising positioning a trash bag at least partially within the trash can, wherein at least part of a circumferential upper portion of the trash bag, proximate the open end thereof, is positioned on or draped over a top surface, such as top surface 40, of the lip.

A Trash Bag Securement Step, comprising rotating each clip inward and slidingly advancing each clip along the lip so as to provide each clip in an engaged position.

The above described method is merely exemplary, and additional embodiments thereof consistent with the teachings herein may be employed. In addition, in other embodiments, one or more of these steps may be combined, repeated, re-ordered, or deleted, and/or additional steps may be added.

While the preferred embodiments of the invention have been described and illustrated, modifications thereof can be made by one skilled in the art without departing from the teachings of the invention. Descriptions of embodiments are exemplary and not limiting. Disclosure of existing patents, publications, and known art are incorporated herein by reference to the extent required to provide details and understanding of the disclosure herein set forth.

I claim:

1. A trash can clip system comprising:
a lip; and
one or more clips;
wherein:
said trash can clip system is positionable proximate to an opening of a trash can;
said lip comprises an elongated component; and
said lip comprises one or more at least partially void sections there along; and
wherein, at least one said clip:
comprises a substantially u-shaped portion that, in an engaged position, accommodates at least a portion of said lip there within;
is positionable along said lip, in a disengaged position, within one said at least partially void lip section;
is outwardly rotatable when positioned in said disengaged position; and
is slidingly reversibly movable along said lip from said engaged position to said disengaged position.

2. The trash can clip system of claim 1, wherein:
said trash can clip system is positionable substantially circumferentially around said opening of said trash can.

3. The trash can clip system of claim 1, wherein:
at least one said clip is not detachable from said trash can clip system.

4. The trash can clip system of claim 1, wherein:
said trash can clip system comprises a plurality of clips.

5. The trash can clip system of claim 4, wherein:
said plurality of clips is substantially evenly spaced along said trash can clip system.

6. The trash can clip system of claim 1, wherein:
said lip extends substantially parallel to a vertical axis of said trash can.

7. The trash can clip system of claim 1, wherein:
at least one said clip comprises an orifice extending longitudinally there through;
at least a portion of a rod extends through said orifice; and
said clip is rotatable about said rod.

8. The trash can clip system of claim 1, wherein:
at least one said clip is sized such that internal dimensions of said u-shaped portion are only nominally larger than external dimensions of said portion of said lip accommodatable there within.

9. A trash can equipped with a trash can clip system comprising:

a trash can; and a trash can clip system;

wherein, said trash can clip system comprises:

a lip; and one or more clips;

wherein:

said trash can clip system is positioned proximate to, or integral with, an opening of said trash can;

said trash can clip system is disposed substantially circumferentially around said opening of said trash can;

said lip comprises an elongated component; and said lip comprises one or more at least partially void sections there along; and wherein, at least one said clip:

comprises a substantially u-shaped portion that, in an engaged position, accommodates at least a portion of said lip there within;

is positionable along said lip, in a disengaged position, within one said at least partially void lip section;

is outwardly rotatable when positioned in said disengaged position; and is slidingly reversibly movable along said lip from said engaged position to said disengaged position.

10. The trash can equipped with a trash can clip system of claim 9, wherein:

at least one said clip is not detachable from said trash can clip system.

11. The trash can equipped with a trash can clip system of claim 9, wherein:

said trash can clip system comprises a plurality of clips.

12. The trash can equipped with a trash can clip system of claim 11, wherein:

said plurality of clips is substantially evenly spaced along said trash can clip system.

13. The trash can equipped with a trash can clip system of claim 9, wherein:

said lip extends substantially parallel to a vertical axis of said trash can.

14. The trash can equipped with a trash can clip system of claim 9, wherein:

at least one said clip comprises an orifice extending longitudinally there through;

at least a portion of a rod extends through said orifice; and said clip is rotatable about said rod.

15. The trash can equipped with a trash can clip system of claim 9, wherein:

at least one said clip is sized such that internal dimensions of said u-shaped portion are only nominally larger than external dimensions of said portion of said lip accommodatable there within.

16. A method of securing a trash bag within a trash can, comprising:

providing the trash can equipped with a trash can clip system of claim 9;

positioning each clip of said trash can clip system in said disengaged position;

rotating outward each clip of said trash can clip system positioned in said disengaged position;

providing or draping a circumferential upper portion of said trash bag, proximate to an open end thereof, over at least a portion of a top surface of said lip;

rotating inward each clip of said trash can clip system positioned in said disengaged position; and slidingly advancing each clip along said lip into said engaged position.

17. The method of claim 16, wherein:

at least one said clip is not detachable from said trash can clip system.

18. The method of claim 16, wherein:

at least one said clip comprises an orifice extending longitudinally there through;

at least a portion of a rod extends through said orifice; and said clip is rotatable about said rod.

19. The method of claim 16, wherein:

at least one said clip is sized such that internal dimensions of said u-shaped portion are only nominally larger than external dimensions of said portion of said lip accommodatable there within.

20. The method of claim 16, wherein:

said trash can clip system comprises a plurality of clips.

* * * * *